US010711359B2

(12) United States Patent
Simakov et al.

(10) Patent No.: US 10,711,359 B2
(45) Date of Patent: Jul. 14, 2020

(54) IRON-BASED ANODE FOR OBTAINING ALUMINUM BY THE ELECTROLYSIS OF MELTS

(71) Applicant: United Company RUSAL Engineering and Technology Centre LLC, g. Krasnoyarsk (RU)

(72) Inventors: Dmitriy Aleksandrovich Simakov, g. Krasnoyarsk (RU); Aleksandr Olegovich Gusev, g. Krasnoyarsk (RU)

(73) Assignee: UNITED COMPANY RUSAL ENGINEERING AND TECHNOLOGY CENTRE LLC, Krasnoyarsk (RU)

( * ) Notice: Subject to any disclaimer, the term of this patent is extended or adjusted under 35 U.S.C. 154(b) by 157 days.

(21) Appl. No.: 14/910,483

(22) PCT Filed: Aug. 19, 2013

(86) PCT No.: PCT/RU2013/000718
§ 371 (c)(1),
(2) Date: Feb. 5, 2016

(87) PCT Pub. No.: WO2015/026257
PCT Pub. Date: Feb. 26, 2015

(65) Prior Publication Data

US 2016/0194772 A1 Jul. 7, 2016

(51) Int. Cl.
*C25C 3/12* (2006.01)
*C22C 30/02* (2006.01)
(Continued)

(52) U.S. Cl.
CPC ..... *C25C 3/12* (2013.01); *C22C 30/02* (2013.01); *C22C 38/02* (2013.01); *C22C 38/04* (2013.01);
(Continued)

(58) Field of Classification Search
CPC .... C25C 7/02–7/025; C25C 7/00; C25C 3/12; C25C 3/08; C25C 3/06; C22C 38/16; C22C 38/08; C22C 30/02; C22C 29/12
See application file for complete search history.

(56) References Cited

U.S. PATENT DOCUMENTS 5,510,008 A * 4/1996 Sekhar ..... C25C 3/12 204/290.01
6,521,115 B2 * 2/2003 Duruz ..... C25C 3/06 204/243.1
(Continued)

FOREIGN PATENT DOCUMENTS

RU 2455398 7/2012
WO 2000040783 7/2000
WO 2005118916 C2 12/2005

OTHER PUBLICATIONS

Gallino et al ("Oxidation and corrosion of highly alloyed Cu—Fe—Ni as inert anode material for aluminum electrowinning in as-cast and homogenized conditions", Corrosion Science, 63, 2012, pp. 293-303) (Year: 2012).*
(Continued)

*Primary Examiner* — Alexander W Keeling
(74) *Attorney, Agent, or Firm* — Hogan Lovells US LLP

(57) ABSTRACT

The invention concerns non-ferrous metallurgy, particularly an anode for electrolytically obtaining aluminum by the electrolysis of fluoride melts. The anode for obtaining aluminum by means of the electrolysis of melts at a temperature of less than 930° C. consists of a base executed of an alloy containing 65-96%$_{wt}$ of iron, less than 35%$_{wt}$ of copper, less than 20%$_{wt}$ of nickel, and one or several additives from molybdenum, manganese, titanium, tantalum, tungsten, vanadium, zirconium, niobium, chromium, aluminum (less than 1%$_{wt}$) cobalt, cerium, yttrium, silicon, and carbon totaling less than 5%, and a protective oxide layer compris-
(Continued)

Figure 1:
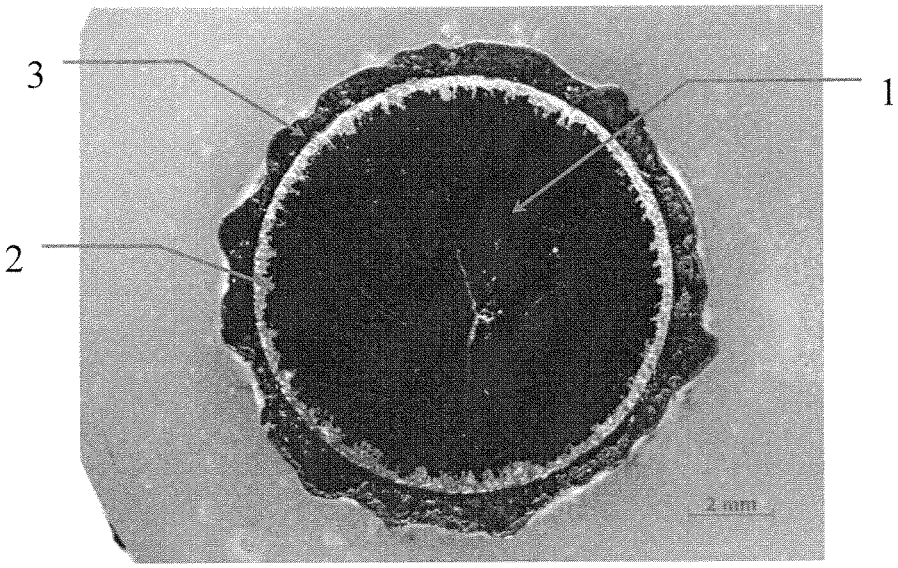

ing iron oxides and complex oxides of iron, copper, and nickel. The protective oxide layer on the anode surface is obtained by preliminary oxidation in air at a temperature of 850-1050° C. or subsequently in the electrolysis process by oxidation with oxygen evolving at the anode.

7 Claims, 1 Drawing Sheet

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/16*** | (2006.01) |

(52) U.S. Cl.
CPC ..... *C22C 38/06* (2013.01); *C22C 38/08* (2013.01); *C22C 38/16* (2013.01)

(56) References Cited

U.S. PATENT DOCUMENTS

| | | | | |
|---|---|---|---|---|
| 7,077,945 | B2 | 7/2006 | Bergsma et al. | |
| 2001/0017267 | A1* | 8/2001 | Duruz | C25C 3/06 205/383 |
| 2005/0000823 | A1* | 1/2005 | Nguyen | C25C 3/06 205/380 |
| 2005/0205431 | A1* | 9/2005 | Nguyen | C25C 3/12 205/372 |

OTHER PUBLICATIONS

International Search Report for PCT/RU2013/000718 dated May 15, 2014.

* cited by examiner

IRON-BASED ANODE FOR OBTAINING ALUMINUM BY THE ELECTROLYSIS OF MELTS

This application is a U.S. National Phase under 35 U.S.C. § 371 of International Application No. PCT/RU2013/000718, filed on Aug. 19, 2013. All publications, patents, patent applications, databases and other references cited in this application, all related applications referenced herein, and all references cited therein, are incorporated by reference in their entirety as if restated here in full and as if each individual publication, patent, patent application, database or other reference were specifically and individually indicated to be incorporated by reference.

The invention concerns non-ferrous metallurgy, in particular an anode for electrolytically obtaining aluminum by the electrolysis of fluoride melts.

At the present time, aluminum is obtained in electrolytic baths (electrolyzers) by the electrolytic decomposition of aluminum oxide ($Al_2O_3$), otherwise known as alumina, which is dissolved in a melt of fluorides at a temperature of about 950° C. This method of obtaining aluminum is called the Hall-Heroult method, after its inventors. Anodes for the electrolysis process are made of carbon, due to which the anodes are continuously consumed as a result of their oxidation by oxygen evolving during alumina decomposition. Because carbon electrodes are used in electrolyzers, carbon oxides and fluorides are continuously generated, and when using the technology of a self-calcining anode, so are carcinogenic semi-aromatic hydrocarbons (polycyclic aromatic hydrocarbons, PAHs), for example benzpyrene. Besides ecological problems, the use of consumable carbon anodes does not allow for improving economic process properties, since the outlay in manufacturing anodes is a significant portion of the cost price of aluminum production. Therefore, since the Hall-Heroult method was invented, searches have been conducted for non-consumable or inert anode materials in which oxygen evolves in the electrolysis process. Various classes of inert anodes have been proposed: metal, ceramic, and cermets. From the point of view of economic efficiency and technical achievability, the anodes that are most preferable are those made of metal alloys on an iron base, since they possess cost less and possess high electrical conductivity, plasticity, and at the same time mechanical strength, they are readily machined and welded, and the permissible limits for iron content in the aluminum are very high (GOST 11069-2001).

An anode is known from patent WO 00/40783, made from high-strength, low-alloy steel containing 94-98%$_{wt}$ of iron and carbon, the remainder being one or several components from the following metals: chromium, copper, nickel, silicon, titanium, tantalum, tungsten, vanadium, zirconium, aluminum, molybdenum, manganese, and niobium and possibly at least a small amount of one of the following additives: boron, sulfur, phosphorus, and nitrogen. An oxide layer forms during oxidation on the surface of the anode, which possesses electrochemical activity for the evolution of oxygen and which has a low solubility in the molten electrolyte. The thickness of the oxide layer is such that it reduces or prevents the diffusion of oxygen through the oxide layer to the steel surface of the anode.

A drawback of this anode is the very high iron content, which leads to its high rate of oxidation. Consequently, at a sufficiently low rate of solution for the oxide layer, which is required in order to obtain aluminum of an acceptable purity, an oxide layer of great thickness will be formed on the anode. Because of this, voltages may arise in the oxide layer, which cause the protective oxide layer to crack. With the long-term use of such anodes, therefore, it will be difficult to obtain aluminum of the necessary purity. With the growth in the thickness of the oxide layer, a drop in voltage also increases across the anode, which leads to an increase in the specific consumption of electrical power.

Anodes are known from patent RU2455398 which are made from a dual-phase Cu—Fe—Ni alloy consisting of a reactive phase rich in iron and a uniform, inert phase rich in copper and containing from 30 to 77%$_{wt}$ of copper, 23 to 65%$_{wt}$ of iron, and up to 15%$_{wt}$ of nickel. An increase in the stability of these alloys is attained due to simultaneously decreasing the electrolysis temperature and limiting the nickel content to amounts not exceeding 15%$_{wt}$. In addition, the presence of an inert phase in the alloy composition ensures the uniform oxidation of the alloy and suppresses its mechanical destruction after oxidation and the solution of the reactive phase at the surface of the anode.

One drawback of these anodes is the low iron content. These anodes therefore have a high cost, which leads to an increase in the cost price for aluminum production using these anodes. In addition, even with a sufficiently low rate of corrosion for these anodes, the copper content in the aluminum being obtained will be greater than the permissible limit of 0.02%$_{wt}$ specified in GOST 11069-2001 for primary aluminum.

An anode made from an iron-based alloy was selected as the closest analogue (a prototype) (US patent 2005/0000823), which contains, in % by weight: Fe 75-90, rare-earth metals such as Y 0.5-5, Al 1-10, Cu 0-10, 0-10 Ni, and other elements 0.5-5. The total quantity of aluminum, copper, and nickel is 5-20%$_{wt}$, while the total quantity of rare-earth metals, aluminum, and copper is also 5-20%$_{wt}$. The anode is used to obtain aluminum by means of the electrolysis of alumina in a molten fluoride electrolyte at a temperature below 930° C. The anode has an electrochemically active, surface oxide layer, which basically consists of iron oxide. The iron oxide is formed as a result of the slow oxidation of iron at the boundary of the alloy and the oxide layer, and it is slowly dissolved in the electrolyte during electrolysis, wherein the rate of the solution and formation of the oxide layer match. In the anode composition are up to 2%$_{wt}$, at least, of one of the following elements: molybdenum, manganese, titanium, tantalum, tungsten, vanadium, zirconium, niobium, chromium, cobalt, silicon, and carbon.

A drawback of the prototype is that there is a significant amount of aluminum in its composition. The aluminum in the prototype is introduced to increase the resistance of the alloy to oxidation by oxygen. Studies have shown that, in the oxidation of such an anode, aluminum oxide and iron aluminate are formed, among other oxides, said two oxides having elevated electrical resistance compared to iron oxides. In addition, the potential of aluminum in fluoride melts is more strongly negative than the evolution potential of oxygen and therefore during electrolysis, selective solution of the aluminum from the anode alloy occurs, with the formation of aluminum fluoride. The aluminum fluoride forming accumulates between the oxide layer and the alloy, forming a fluoride interlayer, which contributes to the development of accelerated alloy degradation. Thus, in the course of using such an anode, its corrosion rate increases severely.

The principal trait of the prototype and of the anode being proposed here is that the anode is made of an iron-based alloy with the addition of nickel and copper, and it is used to obtain aluminum by the electrolysis of fluoride melts at a temperature below 930 C.

The task of the present invention is to create a new anode which can be used to obtain aluminum by means of the electrolysis of fluoride melts, which has a balanced chemical composition and an oxide layer which possesses an elevated electrical conductivity and an increased service life.

The technical result consists of eliminating the fluoride interlayer underneath the oxide layer, which contributes to the development of accelerated anode degradation, increased anode corrosion, and contamination with iron of the aluminum being obtained.

The task set is solved in that, in an anode for obtaining aluminum by the electrolysis of melts at a temperature of less than 930° C., said anode being composed of a base executed of an alloy containing iron, copper, and nickel, and one or several additives of molybdenum, manganese, titanium, tantalum, tungsten, vanadium, zirconium, niobium, chromium, aluminum, cobalt, cerium, yttrium, silicon, and carbon, and a protective oxide layer, according to the technical solution being applied for, the base contains components in quantitative proportions, in % by weight, of:

Fe—65-96,

Cu—up to 35,

Ni—up to 20, additives of molybdenum, manganese, titanium, tantalum, tungsten, vanadium, zirconium, niobium, chromium, aluminum (up to 1), cobalt, cerium, yttrium, silicon, and carbon, totaling up to 5, while said protective oxide layer consists mainly of iron oxides and complex oxides of iron, copper, and nickel.

The invention augments the specific distinguishing traits.

The base is made by casting in a metal or sand mold.

The protective oxide layer on the surface of the anode is obtained by preliminary oxidation of the base in air at a temperature of 850-1050° C. or subsequently in the electrolysis process by oxidation with oxygen evolving at the anode. The thickness of the oxide layer here is 0.1-3.0 mm.

The protective oxide layer consists mainly of iron oxides and complex oxides of iron, copper, and nickel, copper and nickel ferrites, for instance. Also entering into the composition of the protective oxide layer may be a small amount of the oxides of the additives enumerated above. In order to protect the anode from oxidation and fluoridation in the electrolysis process, the composition of the alloy is chosen to be in the range indicated, in order, under specific electrolysis conditions, the oxide layer being formed on the anode is dense and electrically conductive, while the overvoltage for the charge of oxygen ions in the oxide layer is no more than 300 mV. In order to reduce the rate of base oxidation and the rate of solution for the protective oxide layer and, consequently, to reduce contamination with iron of the aluminum being obtained, the anode must be used at a temperature of less than 930° C.

As a result of replacing carbon anodes with inert anodes made of an iron-based alloy in the process of aluminum production in electrolyzers, oxygen will evolve instead of oxides and fluorides and in addition, there will be no PAH waste. Considering the low cost of anodes made of iron-based alloys, their high electrical conductivity and low corrosion rate at an electrolysis temperature below 930° C., the replacement of carbon anodes with the anodes being proposed leads to a reduction in the cost price of aluminum production by the electrolysis of melts. An additional consequence of the low corrosion rate of the anode is a low iron content in the aluminum being produced.

Iron in the alloy composition of the anode base is the principal component, since it provides for a low anode price and for obtaining aluminum meeting GOST 11069-2001, since according to that standard, the permissible limits for iron content in aluminum are very high (up to 0.3%$_{wt}$). With an iron content of less than 65%$_{wt}$, the price of an anode rises substantially, as does the content of the other alloy components in the aluminum being produced, based on which the specifications in GOST 11069-2001 are substantially more stringent. With an iron content of more than 96%$_{wt}$, the rate of anode oxidation rises substantially and voltages at the oxide layer are increased, which leads to its cracking and then to a further increase in the corrosion rate of the anode and a rise in the concentration of iron in the aluminum being produced. In addition, due to an increase in the thickness of the oxide layer, the voltage drop at the anode increases, which leads to an increase in the specific consumption of electrical power in aluminum production.

Copper in the anode composition increases its electrical conductivity. In addition, copper in the fluoride melts has a potential that is very close to the evolution potential of oxygen and consequently is a very favorable component in the alloy. Dense oxide layers are formed on copper and copper alloys during oxidation, and copper is very resistant to fluoridation. The solubility of copper in iron at temperatures of less than 930° C. does not exceed a few percent. Consequently, with higher contents of copper in the alloy, two phases exist, one of which is rich in copper, the other rich in iron. As indicated in patent RU2455398, the phase rich in iron is dissolved in the composition of the two-phase alloy and is oxidized considerably more rapidly than is the second phase that is rich in copper. In such an alloy, a porous surface layer is thereupon formed, which retards further oxidation of the alloy and suppresses its mechanical destruction after the oxidation and dissolution of the phase rich in iron. At the same time, with a copper content of more than 35%$_{wt}$, the price of the alloy rises, as does the content of copper in the aluminum, which should not exceed 0.05%$_{wt}$ (GOST 11069-2001).

Nickel in the anode composition increases the resistance of the alloy to oxidation. In addition, during the oxidation of a nickel-bearing alloy, an oxide layer is formed which contains nickel ferrite, an oxide material possessing a high electrical conductivity, a low overvoltage for oxygen evolution, and a low solubility in a melt of fluorides. At the same time, nickel-based alloys tend to form layers blocking unproductive nickel oxide and fluoride phases. In spite of the unlimited solubility of nickel in iron, during electrolysis, as a result of the selective solution of iron from the surface layer of Ni—Fe anodes, as well as in the case of dual-phase Fe—Cu alloys, a broad porous zone is formed, the metal matrix of which is rich in nickel [D. A. Simakov et al., "Nickel and nickel alloys electrochemistry in cryolite-alumina melts" in: Light metals (2007)]. Thus, at an electrolysis temperature of less than 930° C., an increase of more than 20%$_{wt}$ in the nickel content of the anode being proposed leads to a deterioration in the electrochemical behavior and corrosion resistance of the anode. Also, the price of the alloy thereby increases substantially, as does the nickel content in the aluminum, which must not exceed 0.03%$_{wt}$ (GOST 11069-2001).

The existence of a cause-and-effect relationship between the aggregate of essential traits for the subject being applied for and the achievable technical result is shown in the table. Testing the anodes for corrosion resistance was performed at a temperature of 830-850° C. in a fluoride melt of NaF—KF—$AlF_3$—$CaF_2$, with a 5-6%$_{wt}$ content of dissolved alumina. Samples of the anodes were made by melting batches of metals in a induction furnace or a resistance furnace at a temperature of 1500-1600° C., after which the melt was poured out into a metal chill mold. After cooling the alloy samples in the form of rods, they were machined to a diameter of 10 mm and cut to a length of 60-70 mm. Then the anode samples were welded to a steel top-feed and immersed vertically in a crucible with a fluoride melt, along with a vertically disposed cathode made of sintered titanium diboride. After immersing the electrodes, a direct current was passed through them, which matched the anode current density of 0.5-0.75 A/cm$^2$. Samples with no preliminary oxidation and samples after preliminary oxidation in air underwent testing at a temperature of 850-1050° C. for 3-10 hr. The duration of the testing was 10 hr. After testing ended, the anode samples were cooled and a transverse thin section was made from the center of the working portion of the anode. Using a metallographic microscope for the thin sections, the corrosion resistance of the samples was determined and compared, based on the reduction in sample diameter and the thickness of the porous zone formed, taking into account the purity of the aluminum obtained.

It follows from the tables presented that the anode with an iron content of less than 65%$_{wt}$ and a high total content of copper and nickel (No. 1) demonstrates an elevated corrosion rate at a reduced electrolysis temperature in fluoride melts, and this leads to an increase in the content of copper and nickel in the aluminum. Increasing the content of copper and nickel in the alloy composition thereby substantially increases the price of the anodes. In turn, for the anode with an iron content over 96%$_{wt}$ (No. 7), the corrosion rate and iron content in the aluminum was also sharply increased. Thus, in spite of the low price, such alloys cannot be used as inert anodes. Anodes with an iron content of 65-96%$_{wt}$ (Nos. 2-6) have an optimal combination of iron content from the point of view of alloy price, corrosion rate, and purity of the aluminum being obtained.

Figure 2:
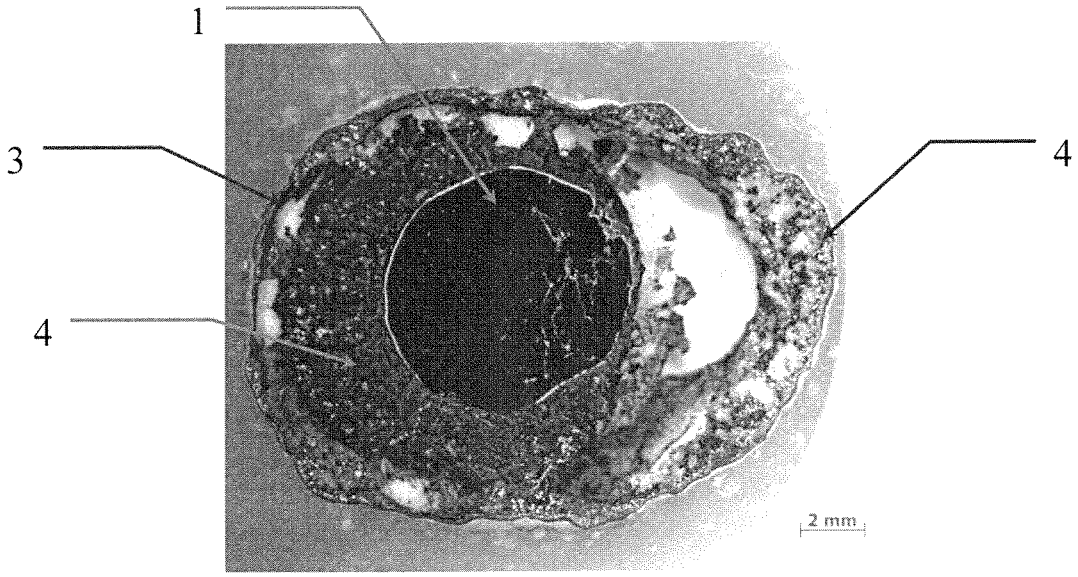
Fig. 2 Prior Art

As an example, a thin-section is shown in FIG. 1 in cross-section from sample 80Fe20Ni (No. 4 in the table) after testing for 10 hr. In FIG. 1, it is shown that a thin porous layer (2) is formed on a metal base (1) after testing, at the surface, whereof a protective oxide layer (3) is found with a thickness of up to 1 mm. It must be noted that contamination of the aluminum with iron in all the anodes exceeds the limits specified in GOST 11069-2001s. However, it must be considered that in the initial period of anode operation, the rate of anode component solution in the melt is at a maximum. Since oxidation is the principal mechanism of anode corrosion for all the alloys, the anode corrosion rate decreases after the formation of a protective oxide layer of sufficient thickness and aluminum contamination is accordingly reduced. The anode based on the prototype (No. 8) has a high rate of corrosion, but contamination of the aluminum in iron therewith is sufficiently low. This is explained by the selective solution of aluminum from the alloy of the anode base, wherein aluminum fluoride forms and accumulates beneath the oxide layer, forming a fluoride interlayer, which contributes to the development of accelerated fluoride degradation of the alloy (FIG. 2). A porous layer is therefore completely lacking in the alloy. In FIG. 2, it is seen that a layer (4) of fluorides with a considerable thickness is found between a thin external oxide layer (3) and the metal base (1). Over a certain operating time for such an anode, a large part of the alloy will be destroyed and collapse of the degradation products accumulated beneath the oxide layer into the melt will occur; a rapid increase in aluminum contamination in iron will follow.

TABLE

| Serial nos. | Anode composition, % wt | Anode current density, A/cm$^2$ | Decrease in diameter, μm | Thickness of porous zone, μm | Contamination of aluminum, % wt Fe | Ni | Cu |
|---|---|---|---|---|---|---|---|
| 1 | 44Fe44Cu12Ni | 0.5 | 870 | 0 | 0.67 | 0.06 | 0.28 |
| 2 | 65Fe25Cu10Ni | 0.5 | 490 | 0 | 1.17 | 0.07 | 0 |
| 3 | 65Fe35Cu | 0.5 | 5 | 813 | 0.5 | 0 | 0 |
| 4 | 80Fe20Ni | 0.5 | 60 | 340 | 0.49 | 0.01 | 0 |
| 5 | 80Fe10Cu10Ni1(Mn + Si) | 0.75 | 0 | 480 | 0.57 | 0 | 0 |
| 6 | 96Fe1.5Cu1.5Ni1(Mn + Si) | 0.75 | 150 | 355 | 1.29 | 0 | 0 |
| 7 | 99Fe1(Mn + Si) | 0.75 | 1600 | 145 | 3.21 | 0.02 | 0 |
| 8 | 90Fe10Al (prototype) | 0.5 | 1390 | 0 | 0.75 | 0 | 0 |

Thus, the experimental data confirm that the invention allows for a reduction in the corrosion rate of inert anodes made of iron-based alloys when obtaining aluminum by means of the electrolysis of alumina dissolved in fluoride melts at a temperature below 930° C. and, consequently, a reduction in contamination with iron of the aluminum being obtained. The task set for the invention is thereby resolved.

The invention claimed is:

1. An anode for obtaining aluminum by means of the electrolysis of melts at a temperature of less than 930° C., the anode comprising:

a base comprised of an alloy containing iron, copper, nickel, and one or several additives selected from molybdenum, manganese, titanium, tantalum, tungsten, vanadium, zirconium, niobium, chromium, aluminum, cobalt, cerium, yttrium, silicon, and carbon, and a protective oxide layer, wherein the base comprises components in the following quantitative proportions, in % by weight:

Fe—65-96,

Cu—less than 35,

Ni—less than 20, and additives of an admixture of molybdenum, manganese, titanium, tantalum, tungsten, vanadium, zirconium, niobium, chromium, aluminum (less than 1), cobalt, cerium, yttrium, silicon, and carbon, totaling less than 5, and wherein the protective oxide layer comprises iron oxides and complex oxides of iron copper, and nickel.

2. The anode according to claim 1, wherein the base is made by casting in a metal or sand mold.

3. The anode according to claim 1, wherein the protective oxide layer on the anode surface is obtained by preliminary oxidation in air at a temperature of 850-1050° C. or subsequently in the electrolysis process by oxidation with oxygen evolving at the anode.

4. The anode according to claim 1, wherein the protective oxide layer has a thickness of 0.1-3.0 mm.

5. The anode according to claim 1, wherein the base does not comprise aluminum.

6. The anode according to claim 1, wherein the protective oxide layer comprises more than 50% by weight iron oxides.

7. The anode according to claim 1, wherein the protective oxide layer does not contain nickel oxide.

* * * * *